US009187958B2

(12) United States Patent
Mensa-Wilmot

(10) Patent No.: US 9,187,958 B2
(45) Date of Patent: Nov. 17, 2015

(54) REAMER WITH IMPROVED PERFORMANCE CHARACTERISTICS IN HARD AND ABRASIVE FORMATIONS

(71) Applicant: Graham Mensa-Wilmot, Spring, TX (US)

(72) Inventor: Graham Mensa-Wilmot, Spring, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 35 days.

(21) Appl. No.: 13/961,660

(22) Filed: Aug. 7, 2013

(65) Prior Publication Data

US 2014/0048335 A1 Feb. 20, 2014

Related U.S. Application Data

(63) Continuation-in-part of application No. 13/585,555, filed on Aug. 14, 2012, now Pat. No. 9,074,434.

(51) Int. Cl.
*E21B 10/43* (2006.01)
*E21B 10/32* (2006.01)

(52) U.S. Cl.
CPC ..... *E21B 10/32* (2013.01)

(58) Field of Classification Search
CPC ..... E21B 10/43; E21B 10/5673
USPC ..... 175/384, 381, 385–392, 406, 413, 431, 175/263–292
See application file for complete search history.

(56) References Cited

U.S. PATENT DOCUMENTS

| | | | | |
|---|---|---|---|---|
| 6,170,576 | B1 | 1/2001 | Brunnert et al. | |
| 6,732,817 | B2 | 5/2004 | Dewey et al. | |
| 7,703,553 | B2 | 4/2010 | Eddison et al. | |
| 7,958,953 | B2 | 6/2011 | Chafai | |
| 8,127,869 | B2 | 3/2012 | Vempati et al. | |
| 2003/0029644 | A1 | 2/2003 | Hoffmaster et al. | |
| 2004/0206549 | A1 | 10/2004 | Dewey et al. | |
| 2007/0078632 | A1 | 4/2007 | Shen et al. | |
| 2007/0240905 | A1 | 10/2007 | Mensa-Wilmot | |
| 2008/0296070 | A1* | 12/2008 | Shen et al. | 175/421 |
| 2010/0051349 | A1 | 3/2010 | Ballard et al. | |
| 2010/0175930 | A1 | 7/2010 | Schwefe | |
| 2010/0276199 | A1 | 11/2010 | Radford | |
| 2010/0276201 | A1 | 11/2010 | Makkar et al. | |
| 2010/0326742 | A1 | 12/2010 | Vempati et al. | |
| 2011/0079443 | A1 | 4/2011 | Buske et al. | |
| 2011/0203850 | A1* | 8/2011 | McClain et al. | 175/57 |
| 2012/0031671 | A1 | 2/2012 | Propes | |
| 2013/0118813 | A1 | 5/2013 | Scott et al. | |
| 2013/0277120 | A1 | 10/2013 | Azar et al. | |
| 2014/0008128 | A1 | 1/2014 | Adam | |

OTHER PUBLICATIONS

Walker Ridge Performance Summary; Anderreamer Concentric Underreamer; National Oilwell Varco; 2009; www.nov.com/downhole.

(Continued)

*Primary Examiner* — Shane Bomar
*Assistant Examiner* — Kipp Wallace
(74) *Attorney, Agent, or Firm* — Pillsbury Winthrop Shaw Pittman, LLP

(57) ABSTRACT

A reamer is designed to enhance operation of a bottom hole assembly in which it is included. One or more capabilities and/or characteristics of the cutters carried by the reamer blocks of the reamer may be varied even in the same profile portion to enhance the functionality and/or durability of the reamer.

4 Claims, 4 Drawing Sheets

(56) References Cited

OTHER PUBLICATIONS

Hydro-Mechanical Anderreamer; Borehole Enlargement; National Oilwell Varco; pp. 1-2; 2008; www.nov.com/BoreholeEnlargement.
Andergauge AnderReamer Cutter Block Progression 1999 to 2005; Andergauge Drilling System; www.andergauge.com.
Hydraulic Anderreamer Tool Technical Summary; Borehole Enlargement; National Oilwell Varco; pp. 1-2; 2010; www.nov.com/BoreholeEnlargement.
U.S. Non-Final Office Action dated Oct. 6, 2014 for U.S. Appl. No. 13/585,555.
International Preliminary Report on Patentability dated Sep. 26, 2014.
International Search Report dated Jan. 17, 2014 for PCT/US2013/054683.
U.S. Office Action dated Feb. 6, 2015 for U.S. Appl. No. 13/585,555.
U.S. Notice of Allowance dated Mar. 5, 2015 for U.S. Appl. No. 13/585,555.

* cited by examiner

REAMER WITH IMPROVED PERFORMANCE CHARACTERISTICS IN HARD AND ABRASIVE FORMATIONS

CROSS REFERENCE TO RELATED APPLICATIONS

This application is a Continuation-In-Part of U.S. Ser. No. 13/585,555, filed Aug. 14, 2012, now U.S. Pat. No. 9,074,434, the entire contents of which is incorporated herein by reference in its entirety.

FIELD

The disclosure relates to the design of reamers for use in the drilling of holes through which hydrocarbon materials are extracted.

BACKGROUND

Bottom hole assemblies are part of the drill string. Specifically, a bottom hole assembly typically refers to the lower part of the drill string, extending from a drill bit to a drill pipe. In some configurations, a bottom hole assembly may include a reamer. A reamer may follow the drill bit down the hole, and may serve to increase the diameter of the hole initially drilled by the drill bit.

Conventional reamers have been designed to match the drill bits with which they are paired. Generally, this matching includes physically matching the configuration of cutters disposed on a reamer, in terms of size, diameter, and/or back rakes with the cutters used on the matched drill bit, and/or attempting to match operating characteristics of the reamer with operating characteristics of the drill bit so that the reamer and the drill bit will react the same to changes in rotary speed and/or weight on bit. As used here, the term "match" means pairing and working together to exhibit predictable behaviors and outcomes.

During operation, however, the attempt to match operation characteristics may prove futile as the drill bit and the reamer proceed in series through different formations, experience wear at different rates and/or in different ways, and/or experience other phenomena that cause mis-matched operation. These sources of misalignment between the operation characteristics of the drill bit and the reamer may become sources of vibration, which, in addition to causing failures to bits and/or reamers, may also cause failures to much more expensive downhole tools, such as logging, imaging, and rotary steerable systems. In additions, these dynamic conditions can contribute to shorter and slower runs, which may in turn force multiple trips and increase operational costs. In hard and/or abrasive formations, and as well depths have gotten deeper, these failures have significant effects on project costs. To bring these costs in line, industry researchers have focused on solutions that will address these problems.

SUMMARY

One aspect of the disclosure relates to a reamer configured for use in forming a hole for the extraction of hydrocarbon materials. The reamer includes a longitudinal body and one or more reamer blocks that are extendible from and retractable toward a rotational axis that runs longitudinally through the reamer. Each of the reamer blocks carries a plurality of cutters that are configured to engage the formation.

On a given reamer block, the cutters may be disposed in a plurality of rows. The cutters on the rows, may run generally perpendicular to the reamer block profile, or be disposed at a tilted angle from perpendicularity. The rows on any said block may run generally parallel to each other. The rows may include a leading row, a trailing row, and/or other rows. The values of one or more design parameters of the cutters in the leading row may be different than the design conditions of one or more parameters of the cutters in the trailing row along the profile of the reamer block.

For example, the leading row may include a first cutter disposed along a profile position that at least partially overlaps with a profile position of a second cutter included in the trailing row of the same block. In other scenarios, a first cutter of a specific row may partially overlap with another cutter in a leading or trailing row on a different block. In addition, a first cutter on a specific row may have total overlap or engulfment with a second cutter on a different row that may be situated in the same or different block. One or more of the size, diameter, and/or shape of the first cutter may be different from the second cutter. A larger size of the first cutter with respect to the second cutter may refer to one or more of a larger extension from the external surface of the reamer block, a cross sectional area, or a diamond area or volume. A different shape of the first cutter with respect to the second cutter may include a difference in geometric cross-sectional shape. A larger diameter may refer to a diameter along a major axis. These cutters may have different geometric cross-sectional shapes, such as round, elliptical, oval cutters, and/or other geometric shapes. The first cutter and the second cutter may have a common geometric cross-sectional shape, but may have different geometric parameters. For example, the first cutter and the second cutter may have different radii, different orientations in axis of symmetry, different numbers of axis of symmetry, different foci, different focal length, different eccentricity, and/or other geometric parameters that are different from each other. A different shape of the first cutter with respect to the second cutter may include a different angle of the face of the cutter with respect to the sides. The back rake and/or side rake of the one of the cutters, in such a first and second cutter description may be different. The first and or second cutters, as described above, and having different sizes, diameters, geometries, back rakes, and/or other parameters, may have common or different radial locations.

The differences in the sizes, shapes, diameters, and/or other parameters of the first cutter and the second cutter (and/or other overlapping cutters in the leading row, the trailing row, and/or other rows) may have different characteristics or properties along the same section of the profile of the reamer block. For example, the first cutter and the second cutter may have different abrasive capabilities as well as impact capabilities. The design parameters, as discussed earlier will establish different levels of efficiency and/or aggressiveness, thereby leading to different performance characteristics.

The plurality of cutters carried on the reamer block may include a hole-opening set of cutters, a hole maintaining set of cutters, and/or other sets of cutters. The reamer block and the opening set of cutters may be formed such that engagement of the opening set of cutters with a surrounding formation opens the diameter of the original hole drilled by the drill bit, that is situated at the end of the BHA to the required hole diameter. The hole-maintaining set of cutters may be carried by the reamer block at a different location and longitudinally away from the opening set of cutters. The cutting tips of the hole-maintaining set of cutters (when reamer is fully opened) share common radial locations with the final hole size that the reamer is expected to open to. The hole-opening and the maintaining set of cutters (deployed on the rows of the reamer blocks) may be formed such that engagement of the maintaining set of cutters with the surrounding formation maintains the diameter of the hole. One or more of the sizes, diameters, and/or shapes (and/or other parameters) of the cutters in the opening set of cutters may be configured to make the opening set of cutters more resistant to wear than the cutters in the maintaining set of cutters. This said configuration may be reversed in some instances, based on the drillability characteristics, in terms of impact and/or abrasion, of the formations being drilled.

These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
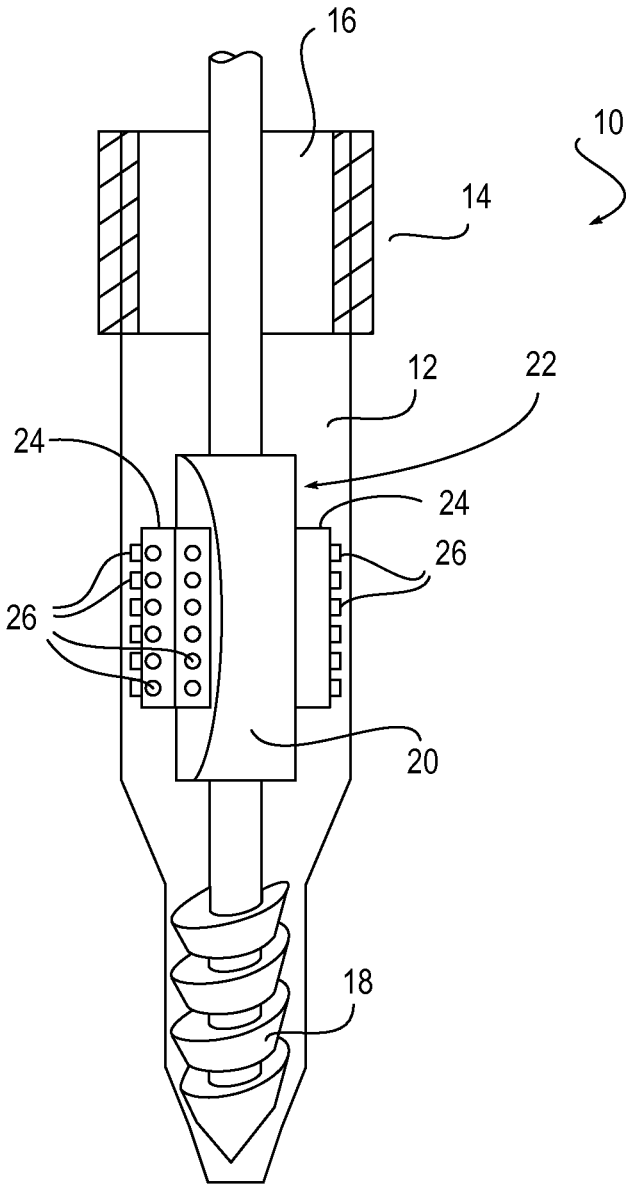
FIG. 1 illustrates a bottom hole assembly configured to excavate a hole section.

FIG. 1 illustrates a bottom hole assembly 10 configured to excavate a hole section 12. Hole section 12 is disposed down hole from casing 14 having a first diameter. The hole including hole section 12 and casing 14, in some implementations, is for the extraction of petrochemical materials (e.g., fluids, and/or other materials). Bottom hole assembly 10 is configured to excavate rock formations to form hole section 12. Bottom hole assembly 10 is connected to the surface, and rotated in hole section 12 by a drill string 16. Bottom hole assembly 10 is configured to enhance the efficiency, effectiveness, resilience, ruggedness, and/or other aspects of convention bottom hole assemblies. Bottom hole assembly 10 may include a drill bit 18, a reamer 20, and/or other components.

Drill bit 18 is disposed at a distal (or "bottom") end of drill string 16. Drill bit 18 is configured such that as drill string 16 rotates drill bit 18, drill bit 18 scrapes, shears, crushes, and/or cuts rock to deepen the hole. Drill bit 18 may be a polycrystalline diamond compact (PDC) bit with one or more PDC cutters. In other instances, drill bit 18 could be a roller-cone bit, a drag bit, a natural diamond or an impregnated bit, and/or other bits. The diameter of drill bit 18 is smaller than the casing diameter, and thus facilitates insertion of drill bit 18 into hole section 12 through casing 14 after casing 14 has been set and cemented in place.

Reamer 20 is configured to enlarge the hole initially formed by drill bit 18. Reamer 20 includes a body 22? and one or more blocks 24. Body 22 and blocks 24 (when in a retracted position) have a diameter that is less than the internal diameter of casing 14. Blocks 24 are configured to axially retract into and/or extend from body 22. With blocks 24 retracted within body 22, reamer 20 can be lowered into hole section 12 through hole casing 14 without impacting casing 14. Once reamer 20 has cleared casing 14, blocks 24 are extended from body 22. This facilitates the excavation of hole section 12 by reamer 20 at a larger diameter than the first diameter of casing 14. In a general sense, the final hole size drilled by blocks 24 is always bigger than the hole size drilled by bit 18.

Individual blocks 24 carry cutters 26. Cutters 26 are cutting elements carried on exterior surfaces of blocks 24 that are configured to excavate rock and enlarge the hole originally drilled by drill bit 18. Such excavation may include one or more of scraping, shearing, crushing, cutting, and/or other excavation. One or more of various design parameters of cutters 26 are configured to control the operation of reamer 20 during the rock removal process. These parameters may include one or more of size, diameter, shape, composition, and/or other parameters. The size of a cutter 26 may include one or more of a surface area of cutter 26 extending from a block 24, a volume of cutter 26 extending from a block 24, a height of cutter 26 extending from block 24, a length of a cutting edge of cutter 26, and/or other sizes. The orientation or shape of a cutter 26 in block 24 may refer to a geometric cross-sectional shape, geometric parameters of the geometric shape, an angle of the face with respect to the side, a back rake of the cutter 26, and/or other variations in shape.

By varying one or more of the size, diameter, shape, composition and/or other design parameters of cutters 26, the operation of reamer 20 in excavating rock can be controlled. Two aspects of the operation of reamer 20 that can be controlled through the design of cutters 26 are efficiency and aggressiveness. Aggressiveness, measured as a slope, refers to the effect on torque as a result of changes in weight as rotary speed is held fixed. As used herein, "weight" refers to the weight on bit or reamer, or the force applied by bottom hole assembly 10 on the bit or reamer during the drilling action. The more aggressive a cutting tool (e.g., drill bit 18 and/or reamer 20) is, the more torque will increase for an increase in weight. Similarly, for a more aggressive tool, a decrease in weight will cause a greater decrease in torque. The efficiency of a cutting tool refers to the torque produced by the cutting tool at a given rotary speed and weight. As such, at a given set of operating parameters (, rotary speed and weight) the relative efficiency of two cutting tools can be compared by comparing the torques generated by the two cutting tools.

Figure 2:
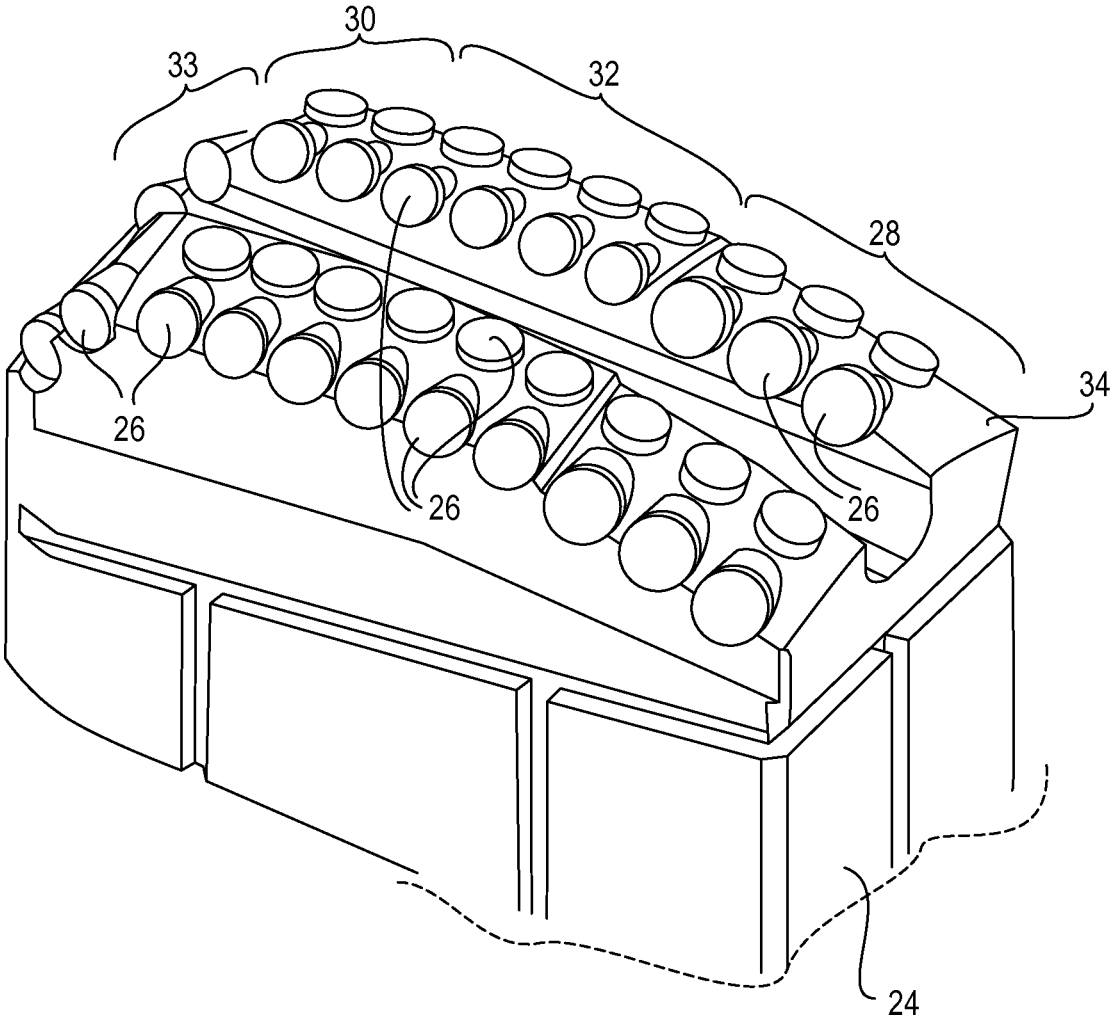
FIG. 2 illustrates a block and cutters of a reamer.
Figure 3:
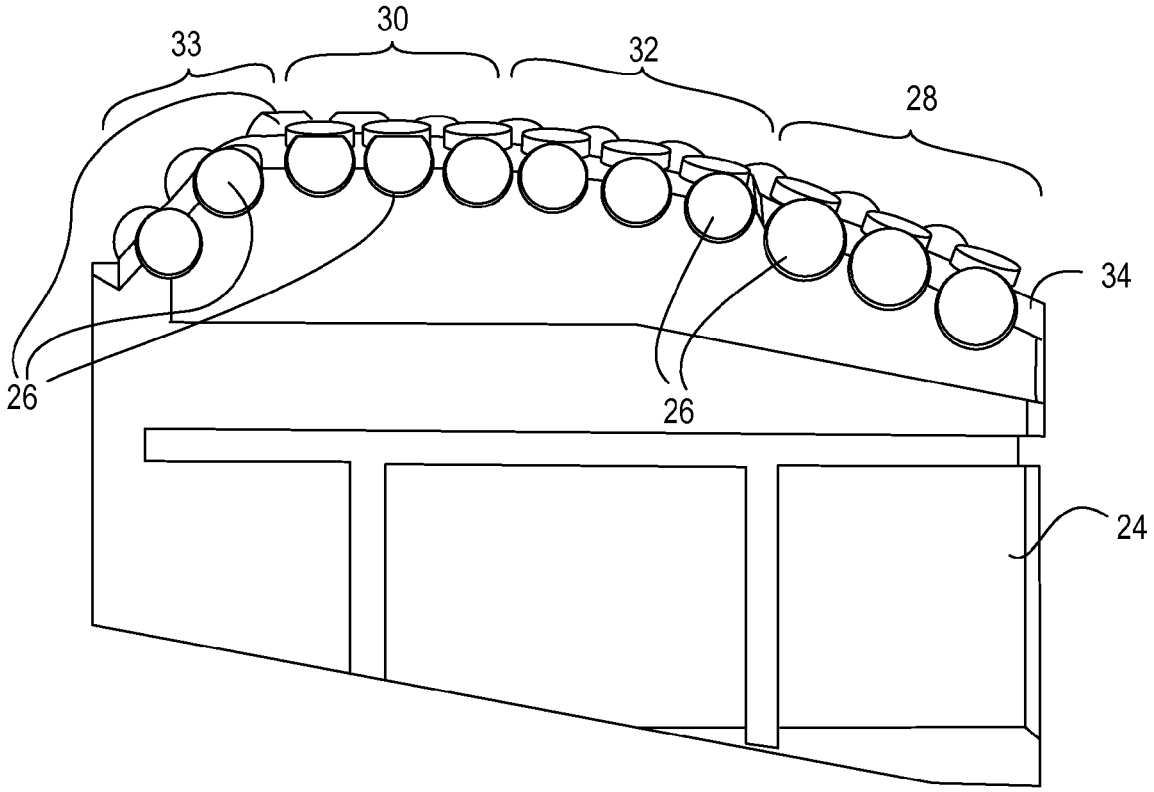
FIG. 3 illustrates a block and cutters of a reamer.

FIGS. 2 and 3 illustrates a block 24 having disposed thereon a plurality of cutters 26. As can be seen in FIGS. 2 and 3, cutters 26 may be arranged in a plurality of rows that run longitudinally along block 24. The rows may or may not have similar exposures, with regards to how they contact and/or fail the formation. For example, in some implementations, cutters 26 disposed toward a down hole end of block 24 may have higher exposure (e.g., be disposed to contact a formation before) than cutters 26 in the same row disposed toward an up hole end of block 24. A given row may or may not form a straight line through the centroids of cutters 26 in the given row.

Cutters 26 may include a plurality of sets of cutters 26. The sets may include one or more opening sets (e.g., a first opening set 28, a second opening set 32, and/or other opening sets), a maintaining set 30, a back-reaming set 33, and/or other sets of cutter 26. An exterior surface 34 on which cutters 26 are disposed may have different shapes for the different sets of cutters 26.

Exterior surface 34 carrying opening sets 28 and/or 32 may be configured to increase a diameter of the hole being formed by the bottom hole assembly. As such, for first opening set 28 exterior surface 34 may be graded such that at a down hole end of exterior surface 34, exterior surface 34 is closer to the longitudinal axis of the reamer carrying block 24 than the rest of exterior surface 34 carrying first opening set 28 of cutters 26. This will cause the diameter of the hole being formed by the bottom hole assembly to be widened by first opening set 28 of cutters 26 as the reamer is moved down into the hole.

Exterior surface 34 carrying second opening set 32 of cutters 26 may have a similar grading to the portion of exterior surface 34 carrying first opening set 28. However, exterior surface 34 carrying second opening set of cutters 26 may be slightly less graded than the portion of exterior surface 34 carrying first opening set of cutters 26. This may provide a transition in the grade of exterior surface 34 with respect to the longitudinal axis of the reamer between the portion of exterior surface 34 carrying first opening set 28 of cutters 26 and the portion of exterior surface 34 carrying maintaining set 30 of cutters 26.

At maintaining set 30, exterior surface 34 may be parallel with the longitudinal axis. By virtue of this shaping of exterior surface 34, at least a portion of cutters 26 in up hole set 30 carried by exterior surface 34 may be disposed farthest from the longitudinal axis. These cutters 26 in maintaining set 30 may extend farthest from the longitudinal axis into the rock. As such, cutters 26 included in maintaining set 30 may act to maintain the widening of the hole effected by cutters 26 in the opening sets 26 and/or 28 as the reamer is moved deeper into the hole.

Back reaming set 33 of cutters 32 is provided up hole from maintaining set 30. Back reaming set 33 may be configured to facilitate movement by the reamer back up the hole. As such, exterior surface 34 of the reamer may be graded such that the portion of exterior surface 34 carrying cutters in back reaming set 32 farthest from maintaining set 30 of cutters 26 is closer from the longitudinal axis of the reamer than the portion of exterior surface carrying cutters in back reaming set 32 that is adjacent to maintaining set 30.

Conventional reamers have typically been designed under the assumption that failure is most likely in cutters 26 in maintaining set 30. Convention wisdom suggests these cutters 26 are most likely to fail because they are carried farthest from the radial axis of the reamer and do the most work, due to their higher radial distances from the central axis of the reamer. As such, in conventional reamers, cutters 26 in maintaining set 30 are higher in count, due to the desire to increase diamond density, and control or minimize wear. This disclosure, on the other hand, suggests that in some implementations reamer block 24 may be designed to reduce failure by cutters 26 in one or both of opening sets 28 and/or 32. This may include designing cutters 26 in one or both of opening sets 28 and/or 32 more resistant to wear and/or impact damage. The cutters 26 in one or both of openings sets 28 and/or 32 may be provided with sizes, diameters, shapes (e.g., back racks, and/or other shape parameters), composition, and/or other features that enhance wear and impact resistance with respect to cutters in maintaining set 30. This is because the present disclosure recognizes that cutters 26 involved in opening the diameter of the hole (e.g., cutters 26 in opening sets 28 and/or 32) can be more susceptible to failure in some operating conditions.

Returning to FIG. 1, while varying the size, diameter, shape, composition, and/or other design parameters of cutters 26 may provide some level of control over the aggressiveness and/or efficiency of reamer 20, varying these parameters may also impact a force balance, bit to reamer weight distribution, and/or other characteristics of the operation of reamer 20. In particular, the design of cutters 26 on blocks 24 of reamer 20 may be determined with a specific weight distribution in mind. The weight distribution may include one or more of the weight distribution of reamer 20 as a whole, the weight distribution of the individual blocks 24, and/or other weight distributions. The weight distribution of reamer 20 and/or blocks 24 may impact which drill bits 18 reamer 20 can be employed with since this distribution affects dynamic performance, vibrations and impact loading on the two cutting tools—that is bit and reamer.

As has been described herein, one or more of the size, diameter, shape, composition, and/or other parameters of various ones of cutters 26 may be designed to enhance durability, that is impact and abrasion resistance of specific cutters 26 and/or sets of cutters 26, and/or to control efficiency and/or aggressiveness of reamer 20. These parameters may further be adjusted based on the stratas in which reamer 20 and bit 18 will be drilling at specific times during the drilling operation. For example, in certain types of formations, an enhanced impact ability may provide better results. In other types of formations, an enhanced abrasive ability may provide better results. If the design of the layout of cutters 26 is not matched to the formation(s) in which it is being deployed, the aggressiveness, efficiency, and/or wear-resistance of reamer 20 may be compromised, thus leading to vibrations, impact damage and accelerated wear, short footages drilled by BHA, low ROP etc—all of which lead to downhole tool failures, unplanned trips, and high operational costs.

In order to enhance the customizability of the design of the layout of cutters 26 on blocks 24, cutters 26 may be disposed on blocks 24 so that the parameters of cutters 26 along an individual portion of the profile of reamer 20 are different. As used here, the "profile" of reamer 20 may include an individual longitudinal section of reamer 20. The cutters 26 along a portion of the profile of reamer 20 would include the cutters 26 within the same longitudinal section that contact the same annular section of the hole as reamer 20 rotates during operation. Providing cutters on the same section of profile with different parameters may enhance wear resistance, cutting capabilities or performance, and/or other operational aspects of reamer 20 while maintaining proper weight distribution.

Figure 4:
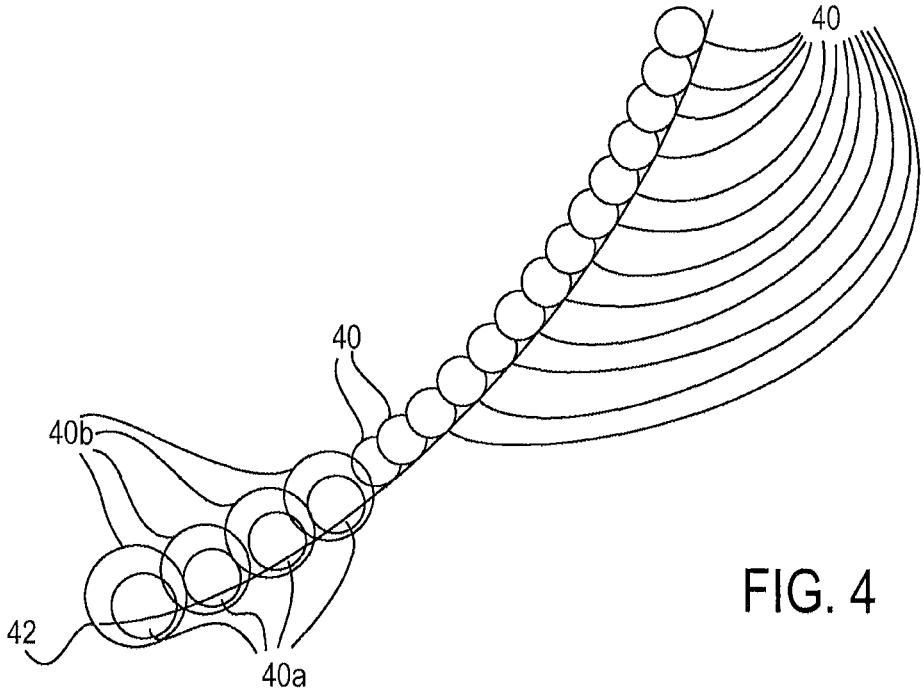
FIG. 4 illustrates a method of designing and/or assembling different reamer types.

By way of illustration, FIG. 4 depicts a profile of a reamer block. In the depiction shown in FIG. 4, individual cutter spaces 40 are depicted. A cutter space 40 may correspond to one or more cutters disposed at a given longitudinal location along the reamer block. As such, a single cutter space 40 may represent a plurality of cutters disposed at an identical location along the profile of the reamer block (e.g., offset on the reamer block at the same longitudinal position) with an identical size—along different segments of the reamer blocks profile, as defined and discussed earlier.

As can be seen in FIG. 4, at a down hole end 42, the hole opening section of the reamer block, the profile includes a set of nested cutter spaces 40*a* nested inside of a set of larger cutters spaces 40*b*. As discussed earlier, cutter spaces 40*a* and 40*b* will be on different leading and/or trailing rows on the same or different reamer blocks. This may signify that the average cutter diameter disposed on the reamer block at the profile portion corresponding to cutter spaces 40*a* and 40*b* may be larger in cross-section than cutters disposed on different sections of the reamer's profile. In other instances, cutters spaces 40*a* and 40*b* while deployed on different rows may be of the same diameter in the specified region, with complete circumferential overlap, whereby the average cutter diameter in this specific region remains larger than the average diameters in the next region. Likewise, the average diameter in the next region. By such a deployment, the average cutter diameter in region 28 may be larger than that of regions 32 and 30. In all instances, one region or cutter space on the reamer as required by the current invention and based on the specific drilling project or application will always have at least one region or cutter space where the average cutter diameter is larger than those of the other regions or cutter spaces along the reamer's profile. In the design shown in FIG. 4, the profile portion corresponding to cutter spaces 40*a* and 40*b* may correspond to an opening set of cutters. The cutters in the opening set of cutters may include a set of cutters on the leading edge of the reamer block (e.g., in a leading row of cutters) that have a larger cross section (corresponding to larger cutter spaces 40*b*). Cutters in this section of the block that trail the cutters at or near the leading edge (e.g., in one or more rows trailing the leading row of cutters) may have a smaller cross section (corresponding to nested cutter spaces 40*c*). This may enhance the resistance of this section of the profile of the reamer block to wear, as the larger cutters corresponding to larger cutter spaces 40*b* withstand the largest amount of force during use. The nesting of different diameter cutters along a common section of profile in this way may facilitate control over wear-resistance, aggressiveness, efficiency, abrasiveness, impact resistance, and/or other operating characteristics of the reamer while maintaining an appropriate weight distribution along the reamer and/or reamer block. An example of this type of cutter lay out can be seen, for example, in first opening set 28 of reamer block 24 shown in FIGS. 2 and 3.

Figure 5:
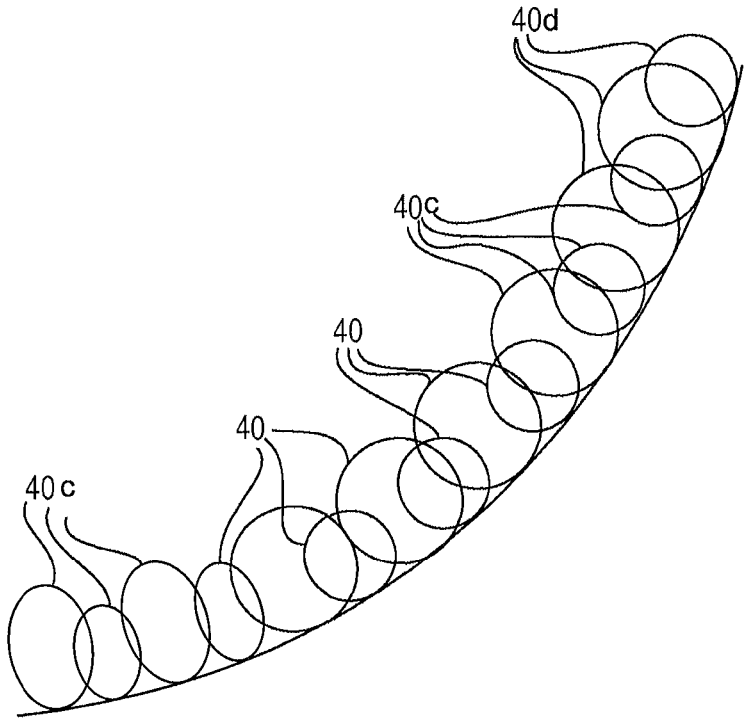
FIG. 5 illustrates a method of designing and/or assembling different reamer types.

FIG. 5 depicts a profile of a reamer block. In the cutter layout represented in FIG. 5, cutter spaces 40 of different diameters are overlapped along the profile. This may correspond to a cutter layout in which cutters of different diameters are staggered in different cutter spaces, where the average diameters of cutters in the different cutter spaces that have been deployed longitudinally across a plurality of rows of cutters are different along the reamer's profile. Such a layout may ensure coverage along longitudinally along the profile, while facilitating inclusion of cutters having different shapes, diameters, sizes, and/or other parameters tailored to provide different characteristics to the reamer. For example, some of the cutters may be designed with sizes, diameters, shapes, design parameters and material properties that improve durability characteristics, specifically, enhanced abrasion properties, while other ones of the cutters may be designed with sizes, diameters, shapes, design parameters and material characteristics that improve impact properties. The staggering of the cutters having different parameters along the profile, while achieving the appropriate weight distribution ensures improved performance in hard and/or abrasive formations by ensuring improved durability characteristics. Cutter spaces 40 may include a first cutter 40*c* and a second cutter 40*d*. A different shape of first cutter 40*c* with respect to second cutter 40*d* may include a difference in geometric cross-sectional shape. A larger diameter may refer to a diameter along a major axis. These cutters 40*c* and 40*d* may have different geometric cross-sectional shapes, such as round, elliptical, oval cutters, and/or other geometric shapes. First cutter 40*c* and second cutter 40*d* may have a common geometric cross-sectional shape, but may have different geometric parameters. For example, first cutter 40*c* and the second cutter 40*d* may have different radii, different orientations in axis of symmetry, different numbers of axis of symmetry, different foci, different focal length, different eccentricity, and/or other geometric parameters that are different from each other. Although the system(s) and/or method(s) of this disclosure have been described in detail for the purpose of illustration based on what is currently considered to be the most practical and preferred implementations, it is to be understood that such detail is solely for that purpose and that the disclosure is not limited to the disclosed implementations, but, on the contrary, is intended to cover modifications and equivalent arrangements that are within the spirit and scope of the appended claims. For example, it is to be understood that the present disclosure contemplates that, to the extent possible, one or more features of any implementation can be combined with one or more features of any other implementation.

What is claimed is:

1. A reamer configured for use in forming a hole for the extraction of hydrocarbon materials, the reamer comprising:

a first reamer block that is extendible from and retractable toward a rotational axis that runs longitudinally through the reamer;

a second reamer block that is extendible from and retractable toward the rotational axis; and multiple cutters carried on the first reamer block and the second reamer block, the cutters being disposed in multiple rows of cutters that run generally longitudinally along external surfaces of the first and second reamer blocks, wherein the rows include a leading row of cutters carried on the first reamer block, the leading row on the first reamer block including a first cutter, and wherein the rows further include a trailing row of cutters carried on the first reamer block or the second reamer block that trails the leading row and includes a second cutter, wherein the first cutter and the second cutter are disposed in the same section of the profile of the reamer, and wherein an aspect of the geometrical cross-sectional shape of the first cutter is different from the second cutter, wherein the first cutter and the second cutter are both non-circular ellipses, and wherein eccentricity is different between the first cutter and the second cutter.

2. The reamer of claim 1, wherein a face of the first cutter has a different orientation with respect to a side of the first cutter than a face of the second cutter has with respect to a side of the second cutter.

3. A reamer configured for use in forming a hole for the extraction of hydrocarbon materials, the reamer comprising:

a first reamer block that is extendible from and retractable toward a rotational axis that runs longitudinally through the reamer;

a second reamer block that is extendible from and retractable toward the rotational axis; and multiple cutters carried on the first reamer block and the second reamer block, the cutters being disposed in multiple rows of cutters that run generally longitudinally along external surfaces of the first and second reamer blocks, wherein the rows include a leading row of cutters carried on the first reamer block, the leading row on the first reamer block including a first cutter, and wherein the rows further include a trailing row of cutters carried on the first reamer block or the second reamer block that trails the leading row and includes a second cutter, wherein the first cutter and the second cutter are disposed in the same section of the profile of the reamer, and wherein an aspect of the geometrical cross-sectional shape of the first cutter is different from the second cutter, wherein the first cutter and the second cutter are both non-circular ellipses, and wherein focal length is different between the first cutter and the second cutter.

4. The reamer of claim 3, wherein a face of the first cutter has a different orientation with respect to a side of the first cutter than a face of the second cutter has with respect to a side of the second cutter.

* * * * *